United States Patent [19]

Minamoto et al.

[11] 4,208,746

[45] Jun. 24, 1980

[54] HUMAN BODY IRRIGATION SYSTEM

[75] Inventors: Naoki Minamoto, Kariya; Tomio Oguma, Anjyo; Naoji Sakakibara, Chiryu, all of Japan

[73] Assignee: Aisin Seiki Kabushiki Kaisha, Kariya, Japan

[21] Appl. No.: 915,850

[22] Filed: Jun. 15, 1978

[30] Foreign Application Priority Data

| | | | |
|---|---|---|---|
| Jun. 17, 1977 | [JP] | Japan | 52-72648 |
| Jun. 17, 1977 | [JP] | Japan | 52-72649 |
| Jun. 17, 1977 | [JP] | Japan | 52-72650 |

[51] Int. Cl.[2] ..... E03D 9/08; F24H 1/00

[52] U.S. Cl. ..... 4/448; 219/296; 219/331; 222/146 HE; 4/420.2

[58] Field of Search ..... 4/6, 7, 172.15–172.17, 4/179, DIG. 3; 222/146 H, 146 HE, 318; 219/296, 300, 301, 306, 328, 331; 128/254, 400; 210/447; 134/57 R, 108; 366/146; 237/59, 8 R; 126/362

[56] References Cited

U.S. PATENT DOCUMENTS

| | | | |
|---|---|---|---|
| 1,935,201 | 11/1933 | Callejo | 4/7 |
| 2,993,108 | 7/1961 | Haake | 219/331 |
| 3,072,259 | 1/1963 | Isreeli | 219/331 |
| 3,594,826 | 7/1971 | Maurer | 4/7 |
| 3,598,380 | 8/1971 | Jilek | 73/343 B X |
| 3,812,543 | 5/1974 | Stinson | 4/6 X |
| 3,947,899 | 4/1976 | Robinson | 4/7 |
| 3,995,326 | 12/1976 | Umann | 4/7 |
| 4,051,042 | 9/1977 | Tullier | 210/447 X |
| 4,096,973 | 6/1978 | Cheko | 222/318 X |
| 4,123,807 | 11/1978 | Oguma et al. | 219/296 X |

*Primary Examiner*—Stuart S. Levy

*Attorney, Agent, or Firm*—Sughrue, Rothwell, Mion, Zinn and Macpeak

[57] ABSTRACT

An irrigation system for human body such as anus and private part. The system comprises a heated water containing tank, a pair of heated water ejection units of an injection nozzle type for scouring or irrigating of anus and private part of female, and a heated air drying apparatus for drying anus and private part. A first temperature sensor is disposed in the tank for controlling intermittently a control circuit associated with a water heating unit in the tank so as to stabilize the temperature of the heated water in the tank. A second temperature sensor is disposed in the tank for deenergizing the water heating unit in the event the temperature in the tank rises up to a predetermined higher level. A pump motor unit and a water passage for mixing and agitating the tank water to avoid non-uniform temperature distribution are associated with the tank. The system further comprises a means for maintaining water level in the tank constant when an irrigation operation does not take place and a means for preventing supply of water into the tank during an irrigation operation to prevent abrupt change of temperature of water in the tank and ejecting from one of the ejection units.

14 Claims, 13 Drawing Figures

700
701
702
703
704
705
1027
851
1028
1001
1026
1025
804
C
N
806
D
805
1003
1007
1016
1015
1021
1017
1009
1002
Z
Z
130
111
112
113
114
272
200
270
106
150
151
212
210
205
201
208
202
203
213
209
207
206
211
252
253
250
251
255
256
254
17
100
115
102

HUMAN BODY IRRIGATION SYSTEM

BACKGROUND OF THE INVENTION

The invention relates to a private part irrigation system for use in the urinal, for example.

A conventional system of this kind is constructed such that water from a suitable supply is fed to a heated water tank having a heating unit disposed therein which is intermittently controlled to heat the water to a desired temperature for subsequent irrigation or ejection use. However, it will be noted that for a body of water encompassing a substantial height, the water temperature will be high in the upper region while it is low in the lower region, and there is a temperature differential also in the lateral direction depending on the arrangement of the heating unit. As a consequence, the water which is sprayed to the private parts of a human body has a varying temperature, causing discomfort to the user.

In the conventional system, there is provided a control thermostat unit which is disposed in the water contained in the tank to sense a change in a temperature thereof and which intermittently controls the connection of the heating unit with a power source therefor. In this manner, the water temperature is controlled to a level which is established by the thermostat unit. However, as mentioned previously, the water temperature has a varying value in the upper and lower regions of the tank and depending on the disposition of the heating unit. The thermostat unit is often disposed in the upper region of the body of water contained in the tank while the discharge port communicating with the ejection passage is formed in the lower region. Since the heated water is to be ejected toward a human body, there must be an upper limit preset on the water temperature in order to avoid a critical damage to the human body such as scalding. It will be understood that the upper limit temperature will be that of the water contained in the upper region while the water in the middle and lower regions will be at a temperature which is substantially reduced than the optimum temperature. Such temperature differential also results in providing a discomfort when the water is ejected toward the human body.

Since the water temperature increases with an increasing elevation, it is necessary for the thermostat unit to detect the water temperature as close to the water level as possible. However, in practice, the temperature sensor of the thermostat unit is arranged to extend from the water level to the middle region in order to assure a reliable detection, with result that the sensor detects a mean temperature over the body of water which extends from the middle region to the water level. This prevents an accurate detection of the maximum water temperature, making it difficult to preset a temperature value at which the thermostat unit is to be operated. Specifically, the operating point for the thermostat unit must be determined from an approximate evaluation of the temperature differential from the upper limit value. Also, the mean water temperature must be predicted when evaluating the temperature differential. It is very difficult to satisfy these requirements, rendering it virtually impossible to achieve an optimum temperature control of the water. It will be evident that such drawbacks will be even more aggraviated when the thermostat unit is located in the lower region.

A conventional system also includes a safety or high limit thermostat unit, in addition to the control thermostat unit, which is operative in the event of a failure of the control unit. The safety or high limit thermostat unit has an operating point which is established at a higher level than that of the control thermostat unit. However, the establishment of the operating point of the safety unit is again difficult for the same reasons as mentioned above in connection with the determination of the operating point of the control thermostat unit.

The system disclosed in the present application represents an improvement over the system described in U.S. Application Ser. No. 704,037, filed July 9, 1976; now U.S. Pat. No. 4,123,807 assigned to Aisin Seiki Kabushiki Kaisha, the assignee of the present application.

SUMMARY OF THE INVENTION

It is an object of the invention to provide an improved and novel private part irrigation system which eliminates various disadvantages and drawbacks of the prior art.

It is another object of the invention to provide a novel private part irrigation system which maintains water contained in a tank, at a uniform optimum temperature.

It is a further object of the invention to provide a novel private part irrigation system which avoids a temperature differential or local variation in the water temperature through the mixing and the aggitation of the water contained in the tank.

It is still another object of the invention to provide a novel private part irrigation system which maintains the water contained in a tank at a uniform optimum temperature to facilitate the determination of location of a water temperature sensor and the establishment of an operating point thereof.

It is a still further object of the invention to provide a private part irrigation system which blocks the supply of cold water to the tank, and hence a reduction in the water temperature from the optimum level, during the irrigation or private part scouring operation.

It is an additional object of the invention to provide a novel private part irrigation system having an agitation function to maintain the water in a tank at a uniform optimum level as well as an irrigation function, both of which are achieved with simple means.

It is yet another object of the invention to provide a novel private part irrigation system of the type mentioned above which prevents a reduction in the water temperature during the irrigation or ejection cycle.

Other objects and advantages of the invention will become apparent from the following description of an embodiment thereof with reference to the drawings.

DESCRIPTION OF PREFERRED EMBODIMENT

Figure 1A:
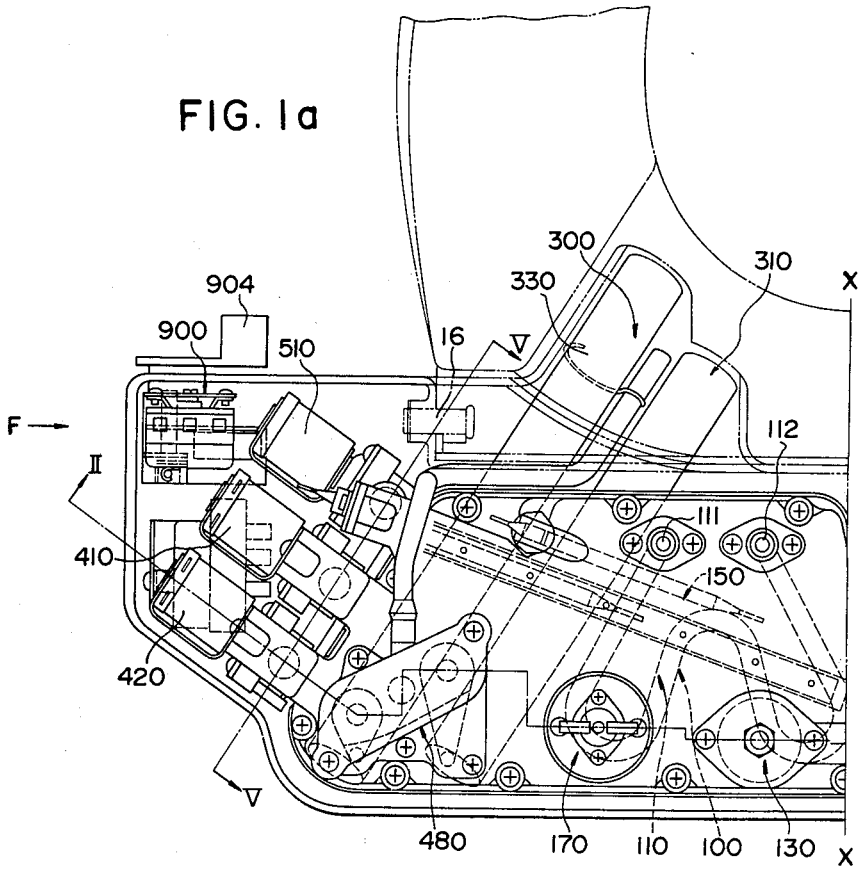
FIGS. 1*a* and 1*b* are plan views of parts of a private part irrigation system of the invention which are split along a line X—X for purpose of convenience, with a cover secured to a baseplate being removed.

Referring to the drawings, an embodiment of the invention will be described. Initially referring to FIGS. 1*a*, 1*b*, 2*a*, 2*b*, 3*a* and 3*b*, there is shown a baseplate 10 on which a heated water irrigation system and a heated air drying apparatus to be used with the private parts of a human body are mounted. Fastening means 11 such as bolts secure the baseplate 10 to the rear end of a urinal 12 (see FIGS. 2*a* and 2*b*). The baseplate 10 is associated with a cover 13 which encloses the irrigation system and the drying apparatus. A urinal seat 14 and lid 15 are pivotally mounted on the cover 13 by means of a pair of pins 16, 16 (see FIGS. 1*a* and 1*b*).

Disposed on the baseplate 10 are a heated water containing tank 100; water passage means 200 which provides a communication between the tank and a supply of water 17 and including water supply control means 201; a heated water ejection unit 300 of an injection nozzle type which ejects the water toward the private parts of a human body; water ejection passage means 400 providing a communication between the ejection unit 300 and the tank 100 and including means 401 which controls the ejection of the scouring water; water agitation passage means 500 (see FIG. 3*a*) to which the water is cyclically transmitted from the tank 100 to mix and agitate the heated water; and means 600 discharging the water from the tank 100 into the both passage means 400 and 500. The components 100 to 600 constitute together an irrigation system. Fan motor means 700 which constitutes the heated air drying apparatus is also mounted on the baseplate 10.

The various parts of the heated water irrigation system will be more specifically described below. The water supply passage means 200 comprises water supply control means 201 of a solenoid valve type including a body 202 fixedly mounted on the baseplate 10, and a strainer assembly 250 secured to the body 202. The strainer assembly 250 includes a body 251 which is secured to the body 202 of valve means 201 by fastening member 252 (see FIGS. 2*b* and 3*b*) and which receives a strainer 253 and is closed by an end cover 254 which threadably engages the body 251. The body 251 is disposed in a vertical orientation relative to the baseplate 10. A pipe 255 connects the strainer assembly 250 with a water supply 17 and has its one end secured to the body 251 by fastening member 256. At least that portion of the pipe 255 which is close to the strainer assembly 250 is disposed in horizontal orientation relative to the strainer 253. Thus, the water is supplied from the source 17 through pipe 255 to the strainer assembly 250 in a horizontal and transverse direction, namely, from the outside to the inside of the strainer 253, whereby a majority of foreign matters such as dirts contained in the water is removed as accumulated on the outer surface of the strainer 253. As a result of such disposition, the cleaning of the strainer 253 is substantially completed by merely cleaning the outer surface thereof after it is removed from the cover 254, thus dispensing with the cleaning of the inside of the strainer and facilitating the cleaning operation. By disposing the strainer 253 in a vertical orientation, it can be removed under gravity, facilitating the removal as compared with an arrangement in which it is withdrawn in the transverse direction. In addition, a splashing of water droplets of foreign matters accumulated or deposited on the strainer is minimized, preventing the likelihood that the clothes of an operator may be wetted.

After passing through the strainer 253, the water is supplied into a passage 203 formed in the body 202 which is secured to the baseplate 10 by a stay 204. Valve means 201 includes a movable member 206 held between the body 202 and a closure 205 and serving as a valve member which controls the communication with the passage 203. It is controlled by the energization or deenergization of a solenoid 207 which responds to an electrical signal as will be further described later. Specifically, when solenoid 207 is energized, a rod 208 extending through an opening in the closure 205 and biased to the right, as viewed in FIG. 2B, by a spring is attracted to the left while overcoming the bias. Passage 203 is divided by the movable member 206 into a first portion 209 located nearer the strainer assembly 250 and a second portion 210 located nearer the tank 100. The first portion 209 communicates with a chamber 212 through an orifice 211 formed in the movable member 206. The free end of rod 208 bears against the movable member 206 to block normally a path 213 which provides a communication between the chamber 212 and second portion 210. However, when the solenoid 207 is energized, the rod 208 opens the path 213 to reduce the water pressure within the chamber 212, allowing the water pressure within the first portion 209 to move the movable member 206 to the left, as viewed in FIG. 2*b*, achieving a direct communication between the both portions 209, 210. When the solenoid 207 is deenergized to return the rod 208 to the position shown in FIG. 2*b* under the bias, water gradually flows past the orifice 211 into the chamber 212, and the pressure within the chamber 212 moves the movable member 206 to the right, as viewed in FIG. 2*b*, into abutment against the body 202 to interrupt the communication between the both portions 209, 210 since the movable member 206 has a greater area exposed to the chamber 212 than exposed to the first portion 209.

The water supply means 200 also includes a pipe 270 which has its opposite ends connected with the body 202 and the tank 100 by threaded fastening members 271, 272, respectively, thus communicating the passage 203 with the tank 100. It is to be noted that the pipe 270 opens into the tank 100 at a level above the highest water level therein.

The tank 100 is fixedly mounted on the baseplate 10 by bolts 101 (see FIG. 2*b*), and includes a tank body 103 in which a quantity of scouring water 102 as supplied from the supply means 200 is stored. The tank body 103 is closed by a cover member 104. A threaded drain plug 105 threadably engages a bottom opening in the tank body 103 in a liquid tight manner (see FIG. 2*a*).

A water heating unit 110, a water level detector 130 and a first and a second water temperature sensors 150, 170 are disposed within the tank 100. The water heating unit 110 includes a heating element 115 having a pair of terminals 111, 112 (see FIG. 3*b*) which are supported by a pair of holders 113, 114. The terminals 111, 112 are connected with an electrical circuit to be described later and which intermittently controls the energization of the heating element 115 to heat the tank water to a desired temperature in response to the sensing of the water temperature by a control thermostat having its sensor disposed in the body of the scouring water 102.

Figure 4:
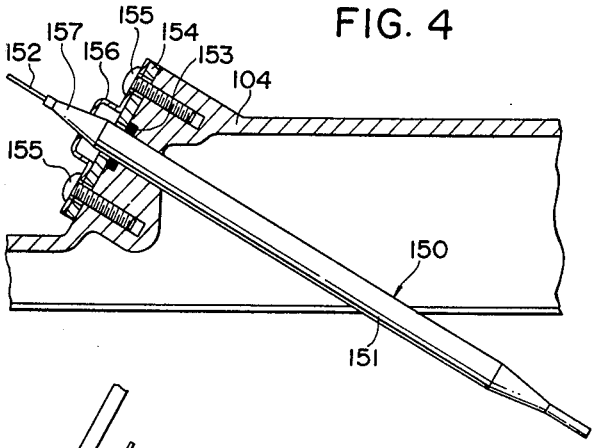
FIG. 4 is a side elevation, particularly illustrating the disposition of the control thermostat unit shown in FIG. 2*a;*

As shown in FIG. 4, the control thermostat unit 150 includes a thermally conductive cylindrical member 151 having its lower end exposed in the water 102 and which is internally filled with a liquid such as xylene, freon or mixture thereof which expands in response to a change in the temperature being sensed. The cylindrical member 151 is connected with a switch assembly through a capillary tube 152 for moving a diaphragm member for operating a switch in response to the expansion or constriction of the liquid in accordance with the water temperature.

The cylindrical member 151 is fixedly mounted in the cover member 104 of the tank 100, with a seal 153 in the form of an O-ring disposed thereon. Specially, the seal is secured in place by a retainer 154 which is secured to the cover member by means of bolts 155 and a bracket 156. The bracket 156 is apertured so that a given length of a tapered upper end 157 of the cylindrical member 151 projects to the outside, thus preventing the cylindrical member 151 from being disengaged from the tank 100. The friction between the member 151 and the seal 153 prevents the cylindrical member 151 from falling into the tank 100. It will be appreciated that the water pressure within the tank 100 also prevents such a free fall of the member 151.

The purpose of the control thermostat unit 150 is to control intermittently a control circuit associated with the water heating unit 110 in accordance with the water temperature sensed in order that water may be maintained at an optimum temperature. The control circuit is also adapted to be controlled by the second water temperature sensor 170 in the form of safety thermostat which is disposed on the cover member 104 of the tank 100, the sensor 170 operating in the event the control thermostat unit 150 fails to operate properly.

Figure 2A:
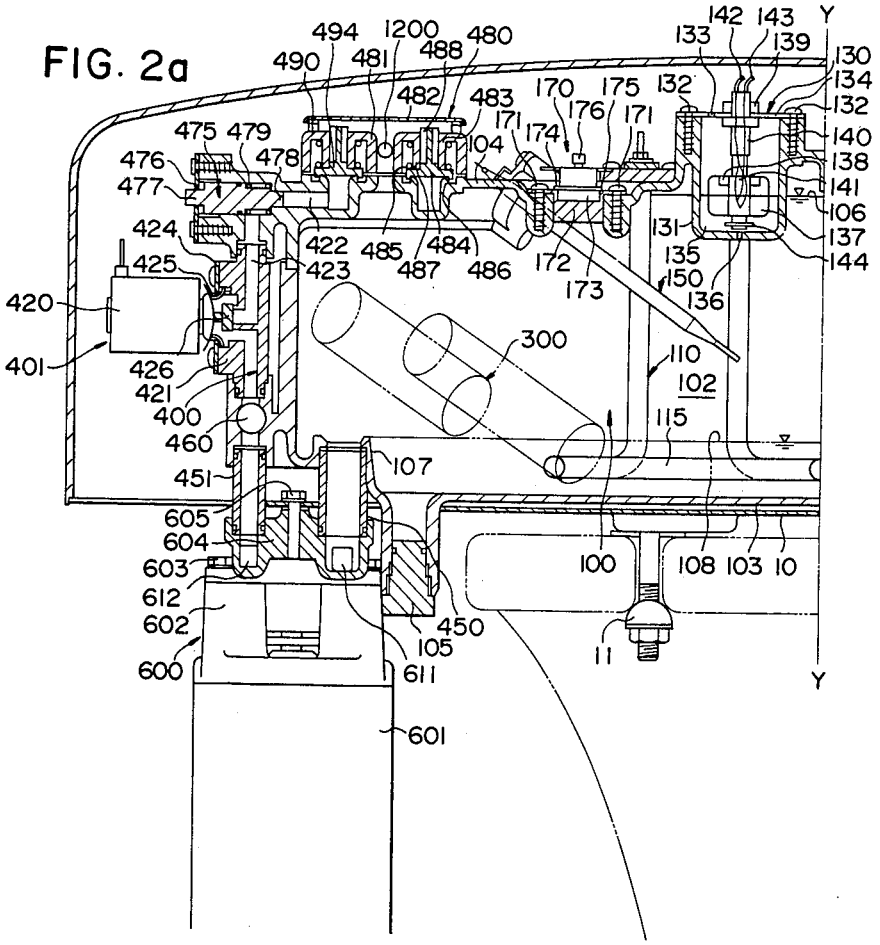
FIGS. 2*a* and 2*b* are cross sections taken along the line II—II of the system and also split along a line Y—Y for purpose of convenience.
Figure 3A:
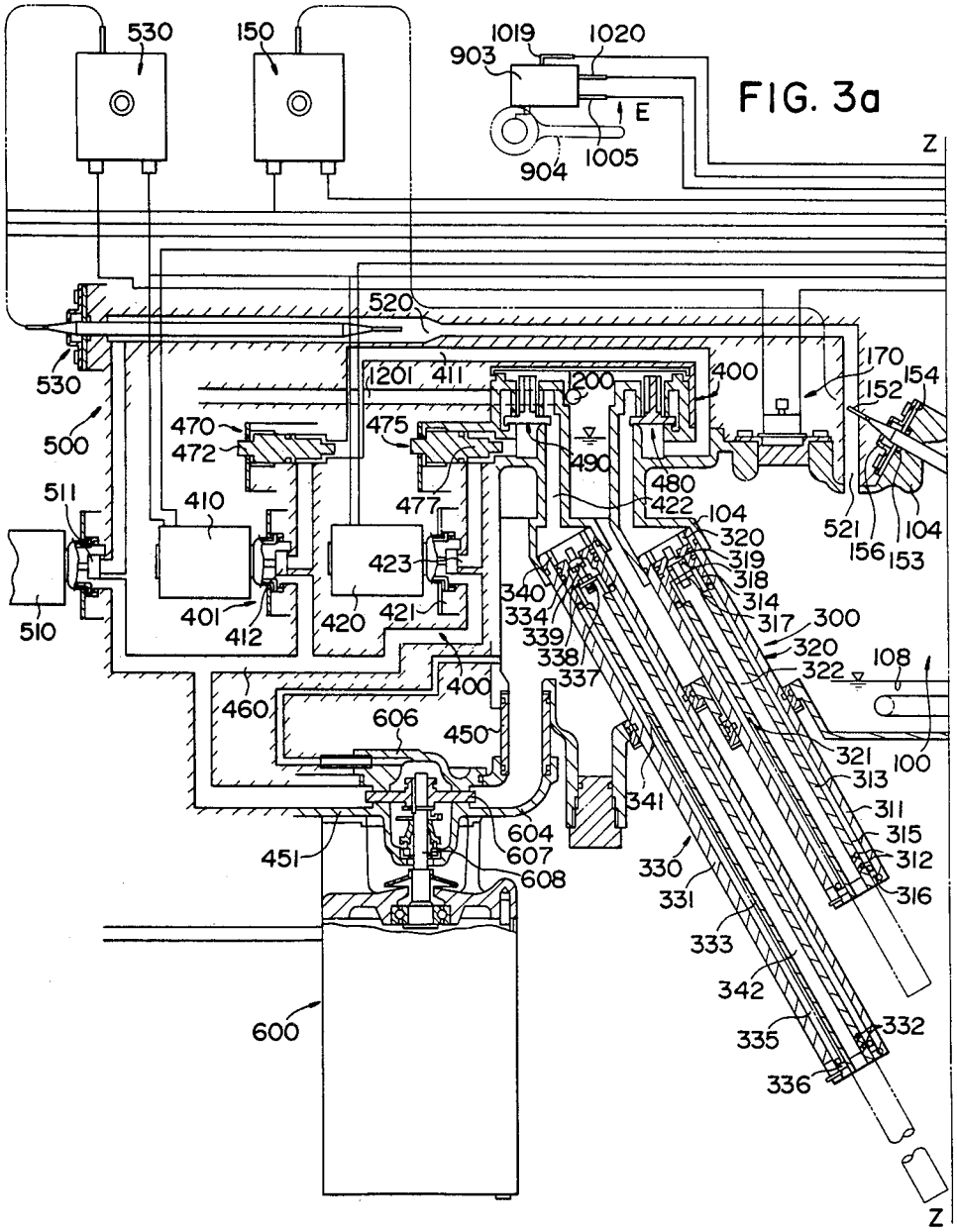
FIGS. 3*a* and 3*b* show principal components of the system and their associated electrical circuits, which are again split along a line Z—Z.

Referring to FIGS. 2*a* and 3*a*, the safety thermostat unit 170 includes a block 172 fixedly mounted in the cover member 104 of the tank by bolts 171, and which is normally exposed to the water contained in the tank 100. The block 172 is formed of a material having a good thermal conductivity so that a change in the water temperature is transmitted to the safety thermostat unit 170 through the block 172. The unit 170 may comprise a normally closed switch formed by bimetal embeded in the block 172 and which opens by flexure whenever a temperature within its body 173 rises above a given value. The normally closed switch has a pair of terminals 174, 175, the connection between which can be interrupted to provide an on-and-off control of the control circuit. The temperature at which the bimetal switch opens may be established at a level higher than the operating point of the control thermostat switch 150 but at a level which is sufficient to prevent a scouring water of abnormally high temperature from being ejected toward the human body in the event of a failure of the control thermostat unit 150. A push button or knob 176 returns the flexed bimetal to its normal position. It should be understood that since the purpose of the safety thermostat unit 170 is to prevent an abnormal rise in the water temperature, a known wax arrangement which opens a normally closed switch by expansion as the temperature rises may be used.

Figure 2B:
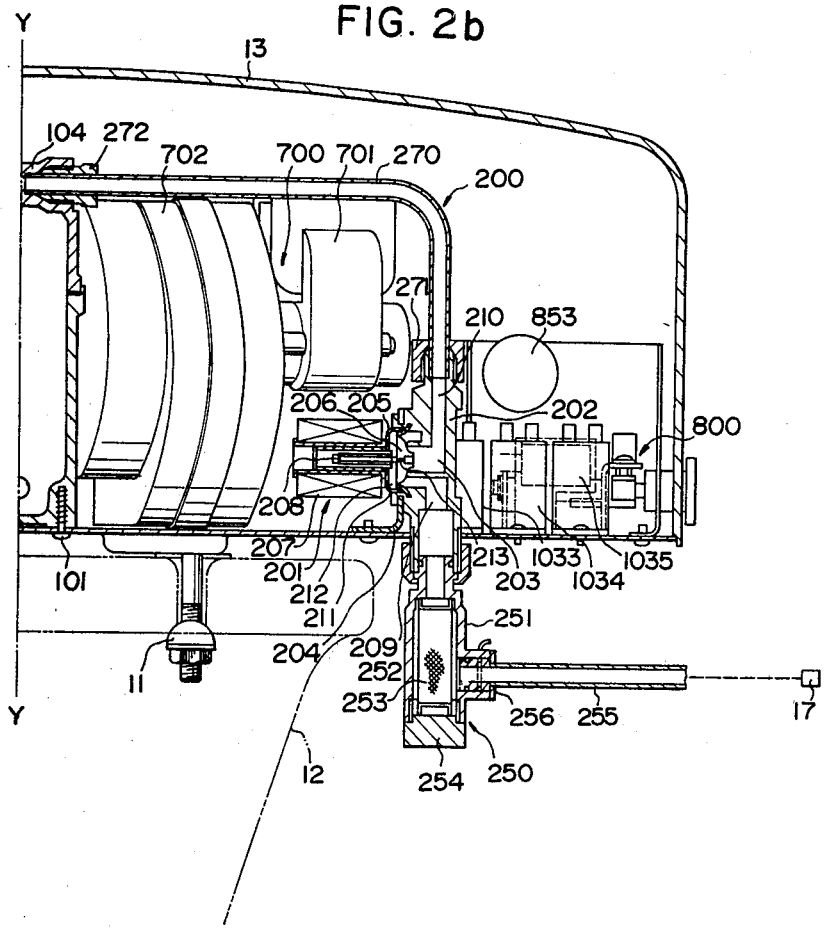

The water level detector 130 includes a housing 131 which is integral with the cover member 104 of the tank and which is closed by a plate 134 secured thereto by bolts 132 and having an air vent port 133 formed therein. In this manner, a float chamber 135 is formed, into which water is admitted through an orifice 136 formed in the housing 131. A float 137 is disposed on the water level and carries a permanent magnet 138 on its upper surface which is adapted to open or close a reed switch 141 contained in a housing member 140 that is supported on the plate 134 by a threaded member 139. FIGS. 2*a* and 2*b* show a condition of the tank 100 in whcih a given quantity of scouring water is contained. Under this condition, the electrical connection between a pair of terminals 142, 143 of the reed switch 141 is interrupted. When the water level is lowered as a result of the irrigation operation until the float 137 bears against a stop 144 mounted below the housing member 140, the switch 141 is closed to complete an electrical signal circuit which enables the supply of the scouring water, as will be further described later. Thus, the water level detector 130 operates to instruct the supply of the water and also to limit the maximum water level 106, by operating the switch 141 when the magnet 131 on the float 137 is displaced relative to the reed switch 141.

The permanent magnet 131 secured to the upper surface of the float 137 is disposed so that it is maintained above the water level and cannot move into the water if the float 137 on which it is mounted is displaced relative to the housing member 140 in accordance with a variation in the water level, thereby assuring that the detection of the water level cannot be degraded or disabled as a result of any magnetic foreign matter such as iron rust in the water being attracted thereto to obstruct the operation of the float 137.

As will be evident from the foregoing description, the float chamber 135 communicates with the water in the tank 100 through the orifice 136, so that the water level at which the detector 130 operates is established a given amount below the maximum water level 106. Stated differently, the orifice 136 presents a resistance to the admission of the water into the float chamber 135 and consequently, when a change in the water level of the tank 100 occurs, a corresponding change in the water level within the float chamber 135 will be delayed. Therefor the water level within the tank 100 will reach its highest level when the water level within the float chamber 135 reaches the particular level at which the detector 130 operates, during the time the water is supplied to the tank.

The undulation or oscillation of the water level within the tank 100 is alleviated by the orifice 136 when the water is supplied into the tank 100 or when an agitation of water occurs in the tank as will be described later, thereby also reducing the undulation of the water level in the float chamber 135 to minimize a resulting movement of the float 137. This prevents an inadvertent turning on and off of the reed switch as a result of the undulation of the water level in the tank, thus providing a full protection of the reed switch which generally has a reduced hysteresis effect and is hence liable to chattering in response to a small undulation of the water level to result in a reduced operative life.

It is to be noted that the task of the detector 130 is to detect the water supply to the tank 100 and to produce a supply signal whenever the quantity of water is less than a given value and to interrupe the supply when the given value is reached. Hence, the detector 130 need not be a water level detector, but may be replaced by any other means such as a water pressure detector.

Referring to FIGS. *2a, 3a* and 5, water discharge means 600 will now be described. The discharge means 600 is formed as a pump motor unit of condense type. Pump motor unit 600 includes a body 601, a flange 602 integral therewith, and a passage forming body 604 which is secured to the flange by tolts 603. The body 604 is directly secured to the baseplate 10 by bolt 605. A runner 607 of a well known form which is driven by a pump motor is disposed in a space defined by the body 604 and a cap 606 which is disposed in liquid tight manner with respect to the body 604. The runner 607 is mounted on a drive shaft 608 of a pump motor and is effective to discharge the water contained in the tank 100 to the ejection and agitation passage means 400, 500 when the motor is energized by an electrical circuit to be described later. An air vent port 609 opens into the tank 100 (see FIG. *3a*). A mechanical seal 610 of a known form is disposed on the drive shaft 608.

The water discharge function of the pump motor unit 600 delivers the water from the tank 100 into the heated water ejection unit 300. Upon completion of an irrigation cycle, the control valve 201 opens to initiate the water supply to the tank 100. Since the air vent port 133 in the detector 130 provides a communication of the internal volume of the tank 100 with the atmosphere, a pressure loading on the tank is avoided. The provision of the pump motor unit 600 having the discharge function permits a water supply of a relatively low pressure to be utilized. An intake passage 611 is formed in the body 604 and communicates with the tank 100 through a hollow annular member 450 which forms part of ejection passage means 400 and agitation passage means 500. On the other hand, a discharge passage 612 is formed in the body 604 and is similarly connected with a hollow annular member 451 which again forms part of the both passage means 400 and 500.

As will be evident from the foregoing description, the pump motor unit 600 is fixedly mounted on the baseplate 10 on which the tank 100 is disposed and in close proximity to the latter. In particular, the passage forming body 604 which forms part of the both passage means 400, 500 is directly mounted on the baseplate 10. Additionally, the passages formed in the body 604 are connected with the ejection and agitation passage means 400, 500, located on the discharge side of the pump and which are partly formed by the tank 100 and the casing 103, through hollow annular members 450, 451 of a reduced length which are disposed therebetween in a liquid tight manner. Stated differently, the tank 100 and the unit 600 are disposed in close proximity to each other, so that a conduit of a substantial length is not required for the connection therebetween, which can be achieved by the hollow annular members 450, 451. This prevents the heated water from the tank 100 from being excessively cooled as a result of a thermal conduction to the connection means comprising annular members 450, 451 and the body 604 during the winter time, thus preventing the scouring water of a reduced temperature from being directed toward human body to cause a discomfort to the user.

The annular member 450 which forms the water intake passage is fixedly mounted in the bottom of the casing 103. As will be noted from FIG. *2a*, the bottom of the casing 103 is formed with an inward projection 107 in such region. Specifically, the projection 107 limits the extent of the discharge from the tank 100, it being understood that portion of the water 102 located below the minimum level 108 which is defined by the level of the opening of the member 450 cannot be discharged. The heating element 115 is disposed in the region defined between the minimum water level 108 and the bottom of the casing 103, thus effectively preventing an idle heating.

Referring to FIGS. *2a, 3a* and 5, the ejection and agitation passage means 400, 500 include a common passage 460 integrally formed with the casing 103 and communicating with the discharge annular member 451, whereby the both passage means can be served by a single pump motor. As will be noted from FIG. *3a*, the common passage 460 is selectively controlled by ejection control means 401 including a pair of passage controllers 410, 420 of solenoid valve type which are disposed in the ejection passage means 400, and also by a passage controller 510 of solenoid valve type disposed in the agitation passage means 500.

The solenoid valves 410, 420 and 510 are fixedly mounted on the casing 103 and the cover member 104 of the tank as will be noted from FIG. *1a*, and they are substantially identical in construction as will be seen in FIG. *3a*. Referring to FIGS. *2a* and *3a*, the solenoid valve 420 will be specifically described. It includes a body 421 which is secured to the casing 103 and the cover member 104 in a liquid tight manner and in which is formed a passage 423 which provided a communication between the common passage 460 and a second ejection passage 422 formed in the cover member 104. Additionally, the valve unit 420 includes a valve body 426 which is movable in a space defined by a cover 425 which is secured to the body 421 by bolts, with a plate 424 interposed therebetween. The valve body 426 is attracted to the left, as viewed in FIG. *2a*, when the solenoid is energized by an electrical circuit to be described later in order to open the passage 423. When the solenoid is deenergized, the valve body returns to the right under the resilience of a spring until it bears against the body 421 to close the passage 423. The solenoid valve units 410 and 510 are constructed substantially in the same manner as the solenoid valve unit mentioned above, each including a valve body 412 or 511 which controls the communication between the common passage 460 and a first ejection passage 411 formed in the cover member 104 and the communication between the common passage 460 and the ejection passage means 500, respectively. In other respects, the arrangement is similar to the valve unit 420 and therefore will not be described.

As shown in FIG. *3a*, the heated water ejection unit 300 includes an anus related ejection mechanism 310 connected with the first ejection passage 411 which is controlled by the solenoid valve unit 410, and a bidet related ejection mechanism 330 connected with the second ejection passage 422 which is controlled by the solenoid valve unit 420. The anus related ejection mechanism 310 includes a cylinder body 311 disposed in a liquid tight manner with respect to the casing 103 and the cover member 104 and which is partly immersed in the tank water. A cylindrical member 313 having nozzle apertures 312 formed therein is slidably disposed within the body 311 and threadably engages a valve holder 314 at its one end so as to be guided by the inner wall of the body 311. When not operated, the other end of the member 313 is supported by an abutment 316 for spring 315 which is secured to the body 311. A valve member 319 is disposed within the valve holder 314 and normally engages a valve seat formed in the holder 314 under the resilience of a spring 318 having its one end connected with the valve member 319 and its other end anchored to a plate 317 which is engaged with a shoulder formed in the inner wall of the cylindrical member 313.

When an irrigation operation does not take place, the valve holder 314 and member 313 are urged by the spring 315 to their positions shown in FIG. *3a* in which they abut against a stop 320, with the valve member 319 being in its closed position. When the solenoid valve unit 410 which controls the ejection of the scouring water is operated to its open position, the water pressure (created by the action of the pump) supplied through the passage 411 and acting on the upper side of the valve holder 314 displaces the members 314, 313 to their operative position which is located below that shown in FIG. *3a*, against the resilience of spring 315. During such displacement, the valve member 319 is maintained in its closed position under the resilience of spring 318 until a shoulder 321 formed on the outer wall of the member 313 bears against the abutment 316 which serves as a stop, thus preventing a premature ejection of water through the nozzles 312. When the member 313 reaches its operative position, the water pressure within the passage 411 is effective to open the valve member 319 against the resilience of spring 318, whereupon the water passes through an internal path 322 formed within the member 313 to be ejected through the nozzles 312. Subsequently, when the solenoid valve unit 410 is brought to its closed position in response to an electrical signal to be described later, which is produced when a given quantity of water has been ejected from the tank 100, the water pressure acting on the valve holder 314 decreases, whereby the spring 315 returns the members 313, 314 to their positions shown in FIG. *3a*.

The bidet related ejection mechanism 330 is similarly constructed as the anus ejection mechanism except that it responds to a separate solenoid valve unit. Specifically, it includes a body 331, nozzle apertures 332, cylindrical member 333, valve holder 334, spring 335, spring abutment 336, plate 337, another spring 338, valve member 339, stop 340, shoulder 341 and internal path 342. Since these parts are similarly constructed as those of the mechanism 310, they will not be described in detail.

It is to be noted however that the body cylinder 331 and cylindrical member 333 of the ejection mechanism 330 have an increased length than the corresponding parts of the ejection mechanism 310 inasmuch as these mechanisms employ nozzle members which project forwardly from the rear end of the urinal under the water pressure, in order to allow the scouring water to be directed to the desired region of the private parts. In addition, to provide a proper control of the direction in which the water is ejected, the nozzle apertures 312, 332 are formed in the respective members 313, 333 at desired angles with respect to the axes thereof. In particular, the nozzle apertures 332 are formed at an angle of inclination from 5° to 30°, preferably 20°, rearwardly from the axes of the member 333 in order to assure a proper ejection of water toward the private part of the female.

It will be noted that the body cylinders 311, 331 of the both ejection mechanisms 310, 330 are partly disposed in the heated water contained in the tank 100 as are the corresponding parts of the nozzle carrying members 313, 333 when the system is not in operation. This brings forth the effect that the members 311, 331, 313, 333 are heated during the quiescent period of the system, avoiding a reduction in the water temperature as it passes through these members when the system operates.

In the similar manner, the ejection passage means 400 and the agitation passage means 500, the detail of which will be described later, are essentially constructed in integral manner with the casing 103 and the cover member 104 which form together the heated water tank 100, so that the thermal conduction from the heated water warms the casing 103 and the cover member 104 which in turn warm the passage means 400, 500, again avoiding a reduction in the water temperature as the water passes through these passage means. This contributes to maintaining a uniform optimum water temperature when combined with the mixing and agitation effect of the scouring water as will be further described later.

Flow rate control means 470, 475 and relief valve means 480, 490 are disposed in the passages 411, 422, respectively (see FIG. 3A). Referring to FIGS. *2a* and *3a*, flow rate control means 475 is carried by a plate 476 which is secured to the cover member 104 as by bolts, and includes a plug 477 which threadably engages a bore formed in the cover member 104 in a liquid tight manner. Toward the ejection passage 422, the plug is tapered as shown at 478 and the tapered portion 478 cooperates with the annular inner wall of the passage 422 to determine an effective cross-sectional area through which the water is passed through the control means. This effective area can be easily controlled by screwing or unscrewing the plug 477, thereby suitably adjusting the discharge quantity and the pressure of water transmitted to the nozzles 332 of the ejection mechanism 330 through the passage 442. It will be noted that the control means 475 is disposed close to the mechanism 330, thus eliminating a degradation in the throttling function of the control means 175 which may be caused by a flow resistance. It will be noted that a spring 479 is disposed in the space defined between the plug 477 and the inner wall of the passage to prevent a play in the region of engagement between the plug and the cover member 104.

The flow rate control means 470 disposed in the passage 411 includes a plug 472, the construction and operation of which is substantially similar to that of control means 475, and therefore will not be described.

Referring to FIGS. *2a* and *3a*, relief valve means 480, 490 have a common housing 481 which is fixedly connected with the cover member 104 in a liquid tight manner, and a cap 482 for the housing. Relief valve means 480 disposed in the passage 411 includes a valve body 484 of a float type which extends through a guide 483 formed in the housing 481. Normally the valve body 484 is maintained in abutment against a seat 486 formed in the cover member 104 under the resilience of spring 485. As a consequence, the passage 411 is disconnected from the ejection mechanism 310. As will be noted from FIG. *3a*, when the solenoid valve unit 410 is brought to its closed position or when the water pressure within the passage 411 decreases upon completion of an irrigation operation, the spring 485 moves valve body 484 into abutment against seat 486, and as the ejection mechanism 310 returns to its non-operative position, any remaining water within the passage between relief valve means 480 and the ejection mechanism 310 will be returned to the tank 100 through the space between the valve body 484 and another seat 487 formed on the housing 481 and through a path 488 formed in the valve body 484. Thus it will be seen that the valve 480 is constructed such that the heated water is not relieved to the urinal but to the tank, thus achieving a saving in the scouring water as well as in the power dissipation which would be required for heating the cold water. In addition, the time required for the heating of the water can be reduced.

When an irrigation operation is to be initiated, the water pressure causes the valve body 484 to abut against the seat 487 against the resilience of spring 485, thus moving valve body 484 away from the seat 486 to permit the supply of the water to the ejection mechanism 310.

The relief valve means 490 associated with the ejection mechanism 330 includes a valve body 494 and associated parts which are similar to those of the relieve valve means 480 and therefore will not be described.

An overflow port 1200 is formed in the sidewall of the housing 481 at a location above the highest water level 106 but below the air vent port 133 formed in the plate 134 of the water level detector 130. The purpose of the overflow port 1200 is to prevent an overflow of the water through the vent port 133 or the like to cause an electrical leakage which way give rise to the risk of producing electric shocks in the vent an excess amount of water is supplied to the tank 100 as when the detector 130 failed to operate properly. In such instance, the water is drained to the urinal through a passage 1201 (see FIG. 3*a*).

Agitation passage means 500 shares the common passage 460 leading to the tank 100 with the ejection passage means 400 and also includes a passage 520 (see FIG. 3*a*) formed in the casing 103 and the cover member 104 and which is connected with the passage 460 through the solenoid valve unit 510. When the valve unit 510 is in its open position and the pump motor unit 600 operates, the tank water is circulated through the agitation passage means 500. As mentioned previously, the temperature of the tank water will be higher as the elevation rises. In addition, the water temperature is also influenced by the location of the heating unit 110, producing a non-uniform temperature distribution throughout the tank 100, which may cause a discomfort to the user when it is directed to the human body. The circulation of water through the agitation passage means 500 is effective to avoid the non-uniform temperature distribution, by mixing and agitating the tank water. In this manner, the discomfort which may be caused to the human body during the irrigation cycle is avoided.

Describing the function of the agitation passage means 500 more specifically, it includes an intake port adjacent to the annular member 450 which opens into the bottom layer of the tank water, and also includes an opening 521 which opens through the cover member 104 to discharge the circulating water to the top layer of the tank water (see FIG. 3*a*). As a consequence, tank water of a relatively high temperature which rise is upwardly into the upper region of the tank is mixed with a tank water of a relatively low temperature which is discharged from the lower region of the tank, thus achieving agitation. In this manner the presence of hot water which is undesirable during the irrigation of the private parts of the human body in the upper region of the tank is avoided.

The uniform water temperature is advantageous not only in avoiding the discomfort which may be caused to the human body upon irrigation, but also in facilitating the provision of the control thermostat unit 150 which is exposed to the tank water between the detector 130 and the heating unit 110 since then its sensor may detect a water temperature in any region of the tank. Additionally, the determination of the operating point for the thermostat unit 150 is facilitated. It will also be seen that the formation of the principal parts of the agitation passage means 500 in integral manner with the casing 103 and the cover member 104 results in their heating by thermal conduction from the tank water, thus avoiding a reduction in the temperature of the water being circulated through the passage means 500.

The agitation passage means 500 includes a high limit thermostat unit 530 located between the valve unit 510 and the discharge opening 521. The unit 530 is mounted on the cover member 104, and is similarly constructed as the control thermostat unit 150 and therefore will not be described specifically. However, the purpose of the high limit thermostat unit 530 is to turn off the heating unit 110 in response to an abnormal rise in the temperature of the circulating water in the event that a malfunctioning of the detector 130 or water supply means 200 results in a failure to supply water to the tank 100 even though the heating unit 110 continues to heat that amount of the water which is located below the sensor of the control thermostat unit 150. It will be apparent that it has also the function of controlling the heating unit 110 when the control and safety thermostat units 150, 170 fail.

It is to be noted that the agitation passage means 500 may be provided with a plurality of other openings as into the passage 520, in addition to the discharge opening 521 into the tank 100 in order to enhance the water circulation and the temperature averaging effect.

Figure 1B:
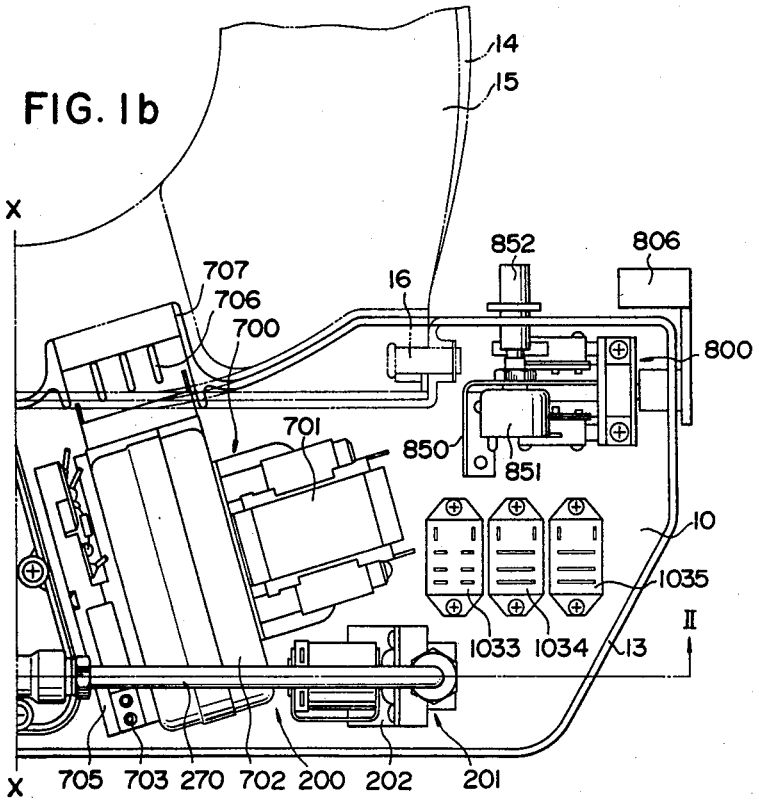
Figure 6:
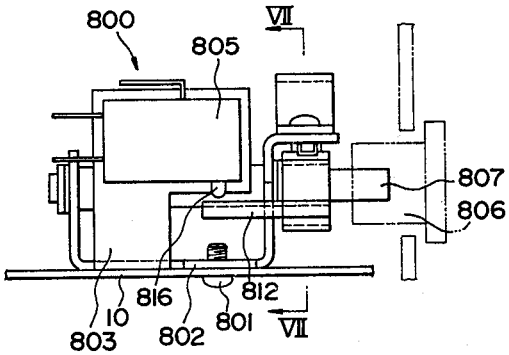
FIG. 6 is a side elevation illustrating manual operating means associated with the irrigation and drying with heated air of the anus.
Figure 7:
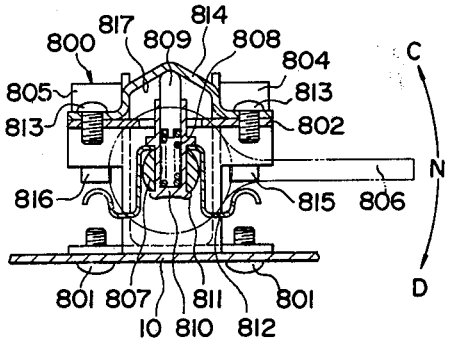
FIG. 7 is a cross section taken along the line VII—VII shown in FIG. 6.

Manual operating means and associated electrical control system for properly operating the irrigation system will now be described. Referring to FIGS. 1*b* and 2*b*, manual operating means 800, including an anus irrigation switch mechanism and a drier switch mechanism is disposed on the right-hand portion of the baseplate 10, while manual operating means 900 including a bidet irrigation switch mechanism is disposed on the left-hand portion of the baseplate 10 as shown in FIG. 1*a*. Referring to FIGS. 6 and 7, manual operating means 800 include a stay 802 which is secured to the baseplate 10 by bolts 801 and integrally carrying a plate 803 on which a pair of microswitches 804, 805 are secured as by set screws. A manual lever 806 is integrally connected with a shaft 807 which extends through the stay 802. A housing member 810 which receives a rod 809 urged by a spring 808 is secured to the shaft 807 as shown by caulking as shown at 811, and a switch plate 812 is interposed between the member 810 and the shaft 807. The rod 809 bears against a rod guide member 814 which is secured to the stay 802 by bolts 813. In the neutral position of the lever 806 which is shown, the switching plate 812 engages neither switch actuator 815 nor 816 of the switches 804, 805.

However, when the manual lever 806 is turned from its neutral position N to an irrigation position C (see FIG. 7), shaft 807 rotates counter-clockwise whereby its integral member 810 rotates in the same direction together with rod 809, which slides along an inner cam surface 817 of the guide member 814 while flexing the spring 808. As a consequence, the right-hand end, as viewed in FIG. 7, of the switching plate 812 operates the actuator 815. When the lever 806 is released, spring 808 returns the rod 809 to the neutral position shown in FIG. 7 together with the switching plate 812 and the manual lever 806.

When the manual lever 806 is turned to its drier position D, plate 812 rotates clockwise to operate the actuator 816. When the manual lever 806 is released, the spring 808 again returns it to the neutral position. Manual operating means 800 also includes changeover switch 851 in the form of a rotary switch which is secured, as by set screws, to a stay 850 which is in turn secured to the baseplate 10. The switch 851 can be operated through a knob 852 extending through the cover 13 (see FIG. 1*a*).

Figure 8:
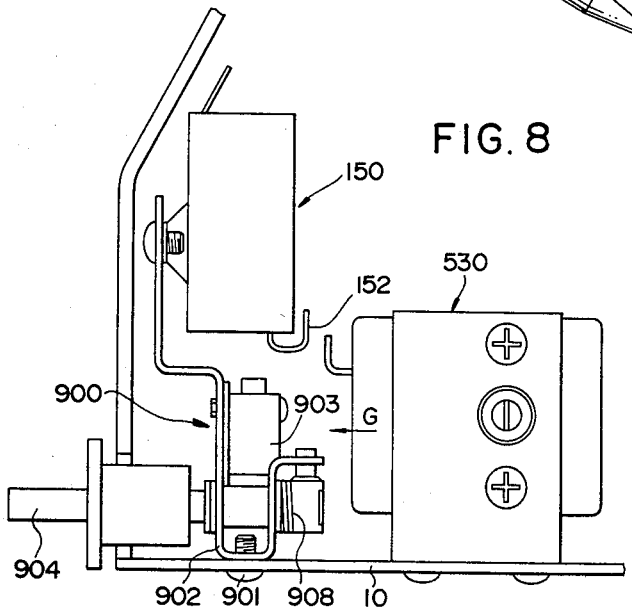
FIG. 8 is a side elevation, as viewed in the direction of arrow F shown in FIG. 1*a*, illustrating manual operating means for a bidet.
Figure 5:
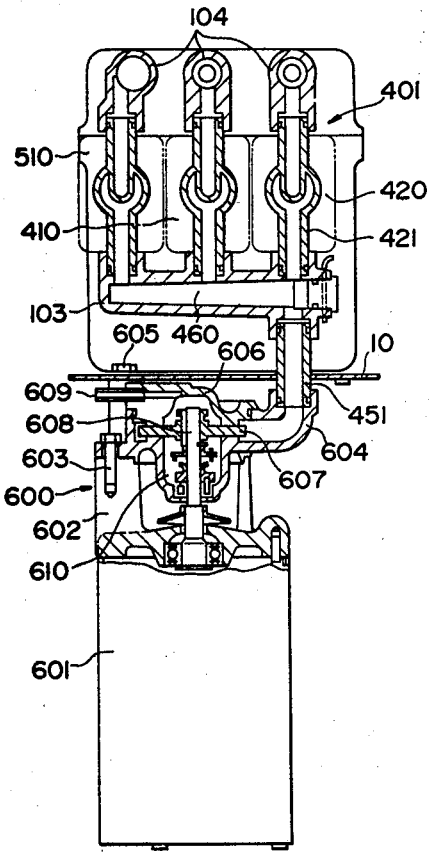
FIG. 5 is a fragmentary cross section taken along the line V—V shown in FIG. 1*a*.
Figure 9:
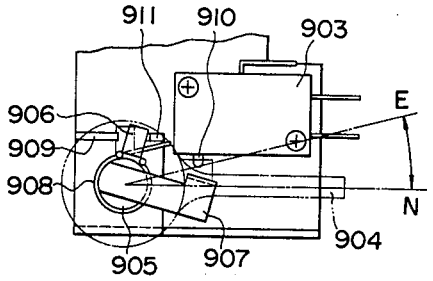
FIG. 9 is a side elevation as viewed in the direction of an arrow G shown in FIG. 8.

Referring to FIGS. 8 and 9, manual operating means 900 associated with the bidet includes a stay 902 secured to the baseplate 10 as by bolts 901, and the stay fixedly carries a microswitch 903 thereon. An operating lever 904 is fixedly connected with a shaft 905 which in turn fixedly carries a stop 906 and a switching plate 907. A return spring 908 is disposed on the shaft 905 and has its opposite ends anchored to the stay 902 and to the shaft adjacent to the stop 906. When the lever 904 is moved from its neutral position N to its irrigation position E as shown in FIG. 9, the shaft 905 rotates in the corresponding direction until the stop 906 bears against an end 909 of the stay 902, whereupon the switching plate 907 operates the actuator 910 of the microswitch 903. When the lever 904 is released, the spring 908 returns the shaft 905 until the stop 906 bears against another end 911 of the stay 902, thus returning the plate 907 and lever 904 to their neutral positions shown in FIG. 9.

FIG. 8 also shows that a switch of the control thermostat unit 150 is mounted on the stay 902 and a switch of the high limit thermostat unit 530 is mounted on the baseplate 10.

It is to be noted that the anus and the bidet related manual operating means 800, 900 are separately disposed on the left- and right-hand ends of the baseplate 10 in order to avoid an inadvertent or wrong operation.

Referring to FIGS. 1*b* and 2*b*, fan motor means 700 mounted on the baseplate 10 may comprise a motor 701 of a shading coil type which has its shaft rotating during the energization of the coil. An impeller is mounted on the motor shaft and is disposed within a fan casing 702. A pair of air heaters 703, 704 (see FIG. 3*b*) are internally housed within a cover 705 which is secured to the casing 702. When the impeller rotates, the heated air is directed to the privates of the human body through a channel 707 which is molded integrally with the cover 13 and which is provided with reinforcing ribs 706, the latter also serving as heated air fairing member.

Figure 3B:
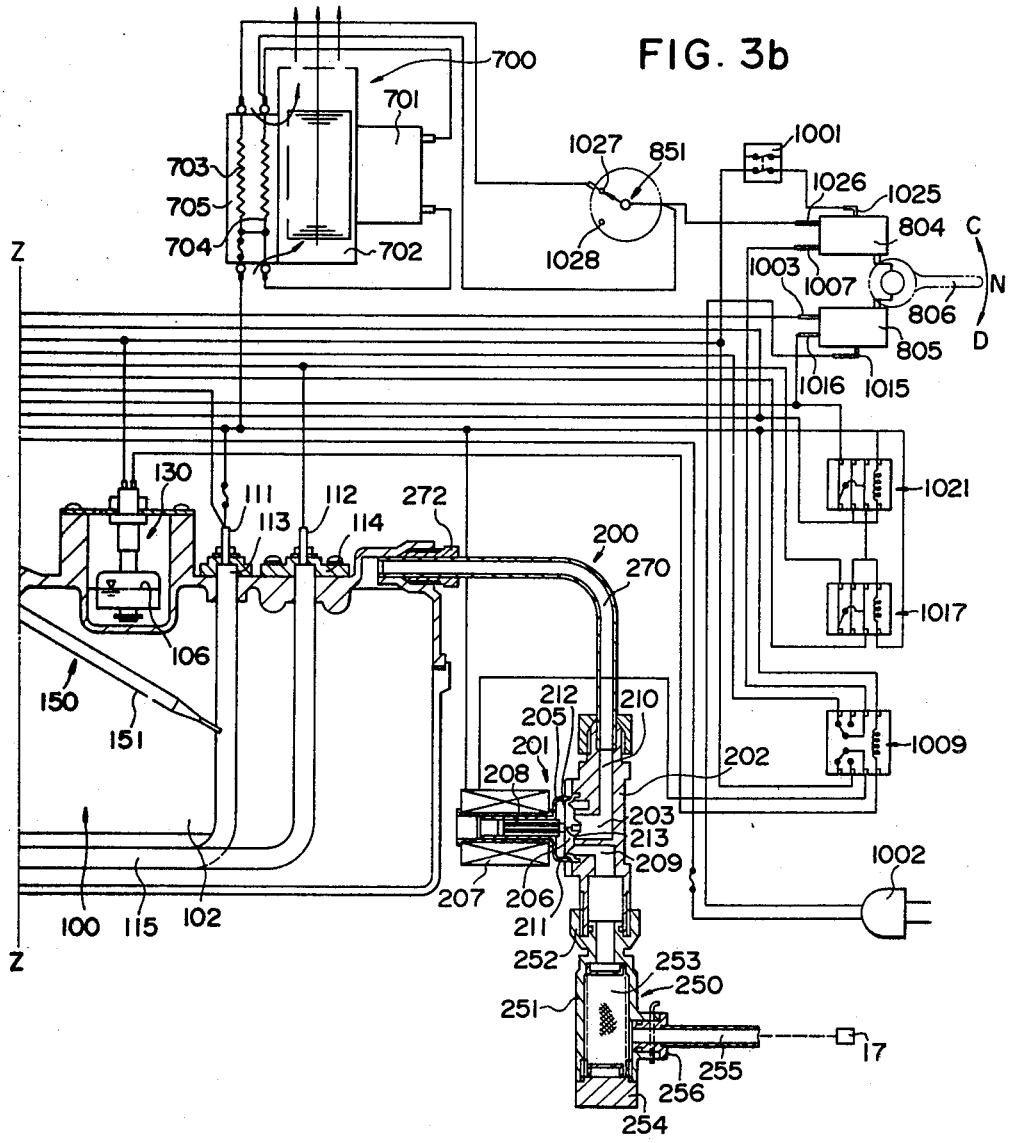
Figure 10:
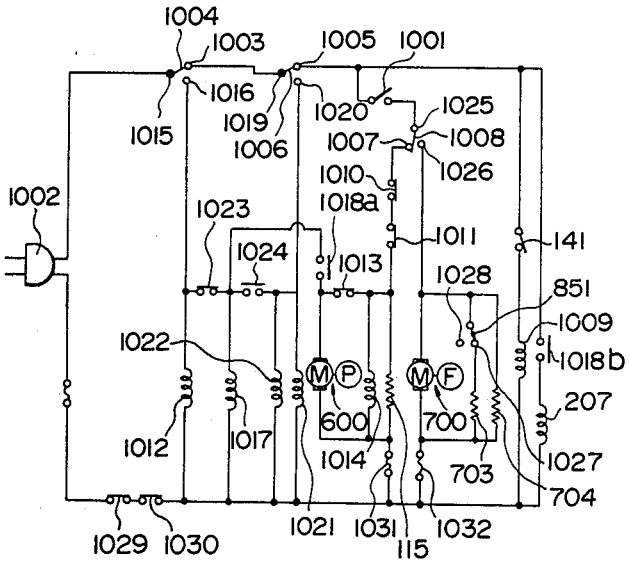
FIG. 10 is a circuit diagram of the electrical circuits shown in FIGS. 3A and 3B.

An electric circuit or electrical control means which controls the operation of the heated water irrigation system and the heated air drying apparatus will now be described with reference to FIGS. 3*a*, 3*b* and 10. When a main switch 1001 is turned on under the condition that a given quantity of scouring water has been supplied to the tank 100, the pump motor unit 600 is connected with a power source 1002 through a plurality of switches including an anus irrigation switch 1004 which is normally connected with the terminal 1003 when manual operating means 800 associated with the irrigation of the anus is not operated; a bidet irrigation switch 1006 which is normally connected with a terminal 1005 when manual operating means 900 associated with the bidet is not operated; a heated air drier switch 1008 which is normally connected with a terminal 1007 when operating means 800 is not operated; a normally closed contact 1010 associated with a relay coil 1009 responsive to the reed switch 141 which detects the water level; a normally closed switch 1011 responsive to the control thermostat unit 150 which senses the water temperature; and a normally closed contact 1013 associated with a solenoid coil 1012 of the anus related solenoid valve unit 410 which is energized in response to the actuation of the irrigation switch 1004. The described path also energizes the heating element 115 of the unit 110 and the solenoid coil 1014 of the solenoid valve unit 510 which is activated for the agitation of the water. Thus, when the water temperature is below a given value, which may be 38° C., for example, the heating element 115 operates to raise the water temperature. The pump motor unit 600 is energized and the solenoid valve unit 510 is brought to its open position, whereby the agitation of the water takes place as mentioned previously in order to achieve a uniform water temperature. The heating and the agitation are interrupted when the water temperature sensing switch 1011 is opened at or above the given temperature. The heating and the agitation process are repeatedly controlled by the operation of the switch 1011, thus maintaining a uniform optimum temperature throughout the tank 100.

When the irrigation operating lever 806 associated with the irrigation of the anus is operated to its irrigation position, the common terminal 1015 of the switch 1004 is thrown to a normally open terminal 1016, energizing solenoid coil 1012 to move the valve body 412 of the solenoid valve unit 410 to its open position. In response to the energization of the coil 1012, a relay coil 1017 is energized to close a normally open contact 1018*a* and to open the normally closed contact 1013. Thus the pump motor unit 600 becomes effective to discharge the heated scouring water to the ejection mechanism 310 through the anus related ejection passage means, thus performing the irrigation operation mentioned above. At this time, the heating and the agitation of the water are interrupted by switch 1004 and contact 1013.

As a result of the irrigation operation, the switch 141 is closed, but since the common terminal 1015 of switch 1004 is thrown to the normally open terminal 1016, the branch including switch 141 is not connected with the source.

After the termination of the irrigation operation when operating lever 806 is returned to its neutral position, the common terminal 1015 of switch 1004 is returned to the terminal 1003, whereupon a relay coil 1009 is energized through the closed switch 141 to close an associated normally open contact 1018*b*, thus energizing the solenoid coil 207 of the control valve unit 201 which is contained in the water supply means 200. Consequently, a sufficient amount of water is supplied from the source 17 to the tank 100 through the supply means 200 until the water level is detected by the switch 141. At this time, a normally closed switch 1010 associated with the relay coil 1009 is opened to deenergize the pump motor unit 600 and the heating element 115.

When the operating lever 904 of the bidet irrigation operating means 900 is moved to its operative position, the common terminal 1019 of switch 1006 is now connected with a normally open terminal 1020 to energize relay coils 1021, 1022. As a consequence, normally closed and open contacts 1023 and 1024 are opened and closed respectively. The coil 1022 is in the ejection control valve unit 420 and associated with the irrigation of the bidet. A relay coil 1017 is energized through contact 1024 to close its associated contact 1018*a*, which makes the pump motor unit 600 operative. As a consequence, the heated scouring water is discharged to the ejection mechanism 330 through the ejection passage means related to the bidet as mentioned previously, performing an irrigation operation. Under this condition, the heating and the agitation of the water are interrupted by switch 1006 and contact 1013.

Again during the irrigation cycle of the bidet, the terminal 1019 of switch 1006 is removed from the terminal 1005, so that the branch including switch 141 is disconnected from the power source, and the supply of the water to the tank is possible only upon completion of the irrigation operation when the terminal 1019 is connected with the terminal 1005.

It will be evident from the above description that fresh supply of water to the tank 100 does not occur during the irrigation operation, thus preventing an undesirable effect that cold water is mixed with the heated water to result in a reduced water temperature.

When the operating lever 806 of manual operating means 800 activates a heated air drier, a common termina; 1025 of drier switch 1008 is connected with a normally open terminal 1026 to energize the fan motor unit 700. Thereupon, a heated air is supplied from the heaters 703, 704 which are controlled by the change-over switch 851. As mentioned previously, switch 851 is turned by the knob 852. When the switch 851 is connected with the terminal 1027 as shown in FIG. 3*b* or 10, the both heaters are operative to supply an air flow of a relatively high temperature. However, when knob 852 is turned to connect the switch 851 with another terminal 1028, heater 703 is deenergized, and only heater 704 is energized to supply an air flow of a relatively low temperature. It should be noted that during the time a heated air flow is supplied for purpose of drying, switch 1008 is removed from the terminal 1007, whereby the irrigation, agitation and heating operations are all interrupted.

A pair of normally closed switches 1029 and 1030 are associated with the safety and the high limit thermostat units 170 and 530, respectively, and are arranged to be opened when the units 170, 530 detect a temperature of about 48° C. A pair of fused 1031, 1032 are connected as shown and have respective fusing temperatures of about 70° C. and 91° C., respectively. Relay coils 1017, 1009 and 1021 are contained in respective coil boxes 1033, 1034 and 1035, which are disposed on the baseplate 10 (see FIGS. 1*b* and 2*b*).

As will be apparent from the above description of the embodiment of the invention, the tank water heated to a given temperature by the heating unit is circulated through the agitation passage means for mixing and agitating the tank water, so that there occurs no temperature differential or non-uniform temperature distribution in the tank water, which is maintained at a uniform optimum temperature in the irrigation system of the invention. It will be appreciated that controlling the water temperature to a uniform optimum value avoids the discomfort to the human body which may be caused by a varying water temperature when ejected toward the private parts of the human body.

Since a major fraction of the ejection passage means is integrally formed with the water tank and is located close to the heated water maintained therein, the passage means itself is heated by the water, avoiding a reduction in the water temperature during the irrigation cycle when the water is passed through the ejection passage means. Additionally, pump motor means is also located close to the tank and is connected therewith and with the ejection means through passage forming means of a reduced length, an overcooling of the passage forming means during the winter time which may result in a substantial reduction in the water temperature upon irrigation is also avoided. A reduction in the water temperature upon irrigation is further avoided by the disposition of the nozzle carrying member which, though being movable to its operative position under the water pressure, is partly located within the heating water tank so as to be normally heated by the heated water. A combination of selected ones or all of such measures which prevent a reduction in the water temperature, together with the mixing and agitation function of the water achieves an irrigation system supplying a scouring water of uniform optimum temperature. This is also assisted by the provision of means which blocks the supply of the cold water to the tank from a water source during the irrigation operation.

When the water mixing and agitating mechanism is used in combination with the ejection mechanism including nozzle carrying members which remain within the tank in their inoperative condition and are movable to their operative position during the irrigation cycle, the nozzle carrying members can be heated more close to the water temperature or heated in a reduced time as a consequence of a greater heat transfer coefficient of the water being circulated as compared with that of the stationary water. This also contributes to the achievement of the irrigation at the optimum temperature.

When the water temperature is maintained uniform throughout the tank as a result of the mixing and agitation function, the water temperature sensors which intermittently control the operation of the heating unit may be disposed anywhere within the path along which the heated scouring water flows. In addition, a setting of the operating point of these sensors is greatly facilitated. It also results in facilitating a setting of the safety or high limit temperature sensing means.

The provision of control valve means within the agitation passage means for interrupting the flow therethrough when the ejection control means becomes operative enables common pump motor means to be shared by both the ejection and the agitation passage means. In addition, pump motor means of a relatively low capacity can be used. The shared use of the pump motor means also permits a single passage portion extending between the tank and the respective control valve means to be shared by the both passage means, thus simplifying the arrangement of the system.

The present system includes an anus related ejection mechanism and a bidet related ejection means incorporated into a single unit, thus affording practical utility.

The use of a non-closed water tank in combination with pump motor means having the discharge function permits a water source of a relatively low pressure to be utilized while avoiding a pressure loading on the tank.

Finally, it should be understood that the present irrigation system has other application in sanitary instruments such as eyewashing application.

What is claimed is:

1. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor said pump motor means comprising a single pump motor unit which discharges the water into the ejection and the agitation passage means and said agitation passage means including valve means which block the agitation passage means in response to an operation of the ejection control means.

2. Human body irrigation system according to claim 1 in which a portion of the ejection passage means extending between the tank and the ejection control means is in common with a portion of the agitation passage means extending between the tank and the valve means, and in which the pump motor unit is disposed in said common portion.

3. Human body irrigation system according to claim 2 in which the heated water tank comprises a casing fixedly mounted on a baseplate, and a cover member secured to the casing, the pump motor unit being secured to the baseplate in proximity to the casing.

4. Human body irrigation system according to claim 3 in which said common portion of the ejection and the agitation passage means comprises a passage forming portion secured to the body of the pump motor unit and including an intake and a discharge opening, a first hollow member of a relatively short length disposed between the passage forming portion and the casing of the tank for transmitting the tank water to the intake opening, and a second hollow member of a relatively short length disposed between the passage forming portion and the casing of the tank for transmitting the water from the discharge opening to the ejection control means and the valve means.

5. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a slidable nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said water ejection unit comprising a body within the tank partly immersed in the tank water, the slidable nozzle carrying member disposed within said body capable of moving to its operative position under water pressure, said member projecting out of the body in its operative position, valve means for permitting the water to be transmitted to nozzle apertures formed in the nozzle carrying member when the member reaches its operative position, and means biasing the nozzle carrying member against the water pressure; said ejection passage means including valve means responsive to the return of said nozzle carrying member to its nonoperative position to return any amount of water remaining between the ejection control means and ejection unit to the tank.

6. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulting the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said ejection control means including a first solenoid valve responsive to a manual operation and said agitation passage means including a second solenoid valve which blocks the agitation passage means when the first solenoid valve opens the ejection passage means.

7. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said water temperature sensor including a control thermostat unit having a sensor portion exposed in the tank water for controlling the operation of the heating unit and a high limit thermostat unit disposed within the agitation passage means for preventing an abnormal rise of the water temperature in the event of a failure of the control thermostat unit.

8. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said detector including a float member carrying a permanent magnet adapted to follow a change in the water level within the tank and a switch mechanism responsive to a displacement of the float member to produce a water level signal, said permanent magnet being secured to the upper surface of the float member so as to be maintained above the water level.

9. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said detector including a first signal generating means which is responsive to a water level below a given level for producing a signal to operate the water supply control means; and said manual operating means which makes the ejection control means operative including a second signal generating means which generates a signal for operating the ejection control means and which overrides the signal produced by the first signal generating means.

10. Human body irrigation system according to claim 9 in which the agitation passage means include valve means which is responsive to the second signal generating means to block the agitation passage means.

11. Human body irrigation system according to claim 9 in which the water supply control means and the ejection control means each include a solenoid valve unit, the first signal generating means including a switch mechanism forming a first electrical signal circuit which energizes the solenoid valve unit of the supply control means, the second signal generating means including another switch mechanism forming a second electrical signal circuit which energizes the solenoid valve unit of the ejection control means and which disconnects the first electrical circuit.

12. Human body irrigation system comprising a heated water tank adapted to contain a quantity of scouring water and including a water heating unit disposed therein, a water temperature sensor disposed in the tank for sensing the water temperature to control the heating unit, water supply passage means providing a communication between a source of water and the tank and including water supply control means disposed therein, a detector for detecting when the quantity of the tank water reaches a given value and for operating the supply control means, a heated water ejection unit including manual operating means, a nozzle carrying member which causes the water to be ejected toward part of a human body, heated water ejection passage means providing a communication between the tank and the ejection unit, means disposed within the ejection passage means and responsive to said manual operating means to control the ejection of the water, a water agitation passage means providing a communication between first and second opening means formed in the tank for circulating the water therebetween for agitation of the heated water contained in the tank, pump motor means disposed in the ejection passage means and the agitation passage means and having a water discharge and agitation function, and means for controlling said pump motor means during said agitation function in response to said water temperature sensor; said tank being provided with an air vent port above the highest water level.

13. Human body irrigation system according to claim 12 in which the tank includes a casing and a cover member which is secured to the casing, the detector including a plate which is secured to the cover member and housing a detection mechanism, the air vent port being formed in the plate.

14. Human body irrigation system according to claim 13 in which the tank is provided with a water overflow port intermediate the air vent port and the highest water level.

* * * * *